US006091917A

United States Patent [19]

Aoki

[11] Patent Number: 6,091,917

[45] Date of Patent: Jul. 18, 2000

[54] IMAGE FORMING APPARATUS IN WHICH A CHARGER PROVIDED WITH A CHARGING WIRE AND A GRID IS DETACHABLY MOUNTABLE

[75] Inventor: Kazuaki Aoki, Mishima, Japan

[73] Assignee: Canon Kabushiki Kaisha, Tokyo, Japan

[21] Appl. No.: 09/406,720

[22] Filed: Sep. 28, 1999

[51] Int. Cl.[7] ..... G03G 15/02

[52] U.S. Cl. ..... 399/115

[58] Field of Search ..... 399/115, 171, 399/172, 90; 361/229; 250/324

[56] References Cited

U.S. PATENT DOCUMENTS 4,550,253 10/1985 Hashimoto ..... 250/324
4,835,568 5/1989 Howard et al. ..... 399/315
5,206,784 4/1993 Kimiwada et al. ..... 399/115

*Primary Examiner*—Arthur T. Grimley
*Assistant Examiner*—Remmon R. Fordé
*Attorney, Agent, or Firm*—Fitzpatrick, Cella, Harper & Scinto

[57] ABSTRACT

An image forming apparatus includes a photosensitive drum, a charger detachably mountable with respect to a main body of the image forming apparatus and having a charging wire, a wire electrode for receiving a voltage to be supplied to the charging wire, a grid, and a grid electrode for receiving a voltage to be supplied to the grid, a wire power-feeding contact arranged to come into contact with the wire electrode, and a grid power-feeding contact arranged to come into contact with the grid electrode, wherein, in mounting the charger in the image forming apparatus, the wire electrode comes into contact with the wire power-feeding contact after the grid electrode comes into contact with the grid power-feeding contact.

3 Claims, 3 Drawing Sheets

IMAGE FORMING APPARATUS IN WHICH A CHARGER PROVIDED WITH A CHARGING WIRE AND A GRID IS DETACHABLY MOUNTABLE

BACKGROUND OF THE INVENTION

1. Field of the Invention

The present invention relates to an image forming apparatus, such as a copying machine, a printer or the like, and, more particularly, to an image forming apparatus in which a corona charger is used to charge an image bearing member.

2. Description of Related Art

FIG. 1 is a cross-sectional view showing, by way of example, the essential parts of an electrophotographic-type image forming apparatus.

Referring to FIG. 1, a photosensitive drum 1, which serves as an image bearing member, has a photoconductive layer provided on a cylindrical conductive base member thereof, and is so supported as to be rotatable in the direction of an arrow R1.

Around the photosensitive drum 1, there are disposed, in order along the rotating direction thereof, a scorotron charger 2 for charging the surface of the photosensitive drum 1, an exposure device for reading an original to produce an image signal and exposing the photosensitive drum 1 on the basis of the image signal to form an electrostatic latent image on the photosensitive drum 1, a developing device 4 for causing a toner to adhere to the electrostatic latent image to form a toner image on the photosensitive drum 1, a surface-potential sensor 5 for detecting the surface potential of the photosensitive drum 1 in the vicinity of the developing device 4, a transfer charger 8, such as a corona transfer charger, for transferring the toner image formed on the photosensitive drum 1 to a transfer sheet P, which serves as a transfer material, a separation charger 9, such as an electrostatic separation charger, for separating the transfer sheet P having the toner image transferred thereto from the photosensitive drum 1, a cleaning device 13 for removing toner particles remaining on the photosensitive drum 1 even after the transfer of the toner image, an exposure lamp 30, which serves as a pre-exposure device, for removing charges remaining on the photosensitive drum 1, and so on.

The transfer sheet P having the toner image transferred thereto is transported to a fixing device 12 after having been separated from the photosensitive drum 1. At the fixing device 12, the toner image on the surface of the transfer sheet P is fixed to form a desired print image. Then, the transfer sheet P is discharged to the outside of the main body of the image forming apparatus.

Further, an image scanner unit 18 is provided for reading an original 15 placed on an original-placing glass board 14 by scanning the original 15 with an illuminating lamp 16, and for converting image information obtained by the scanning into an electrical signal by using a photoelectric conversion element 19. In the image scanner unit 18, reflected light from the original 15 scanned with the illuminating lamp 16 is guided to a lens 19 by mirrors 17*a*, 17*b* and 17*c* and is then imaged on the photoelectric conversion element 19 by the lens 17*d*.

The electrical signal obtained by the photoelectric conversion element 19 is digitized by an A/D converter 21, and is then converted by an image signal processing part 22 into an image signal represented with 256 gradation levels of from "0" (00hex) to "255" (FFhex) proportional to individual image density levels.

The image signal outputted from the image signal processing part 22 is supplied to a laser driver 24. The laser driver 24, which serves as a signal generating part, modulates the light emission of a laser 20 in accordance with the image signal.

A laser beam 3 obtained by the light emission modulated in accordance with the image signal is made incident on the photosensitive drum 1 via a polygonal mirror 28 and a mirror 17*e*, so that an electrostatic latent image is written to the photosensitive drum 1.

The photosensitive drum 1 may have good charging capability or poor charging capability due to uneven products thereof.

Further, since the charging capability of the photosensitive drum 1 depends on the amount of light of the pre-exposure, the charging capability of the photosensitive drum 1 varies according to the unevenness of the amount of light of the pre-exposure or the decrease of the amount of light of the pre-exposure due to the repeated usage.

In addition, the charging capability of the photosensitive drum 1 varies according to the variation of the discharging characteristic of the scorotron charger 2, the variation of the charging characteristic of the photosensitive drum 1, etc., due to the repeated usage or the variation of an environment where the image forming apparatus is used.

In order to absorb the above-mentioned unevenness or variation, such a technical art is known that the surface-potential sensor for detecting the surface potential of the photosensitive drum 1 is provided in the image forming apparatus and is used to vary a voltage to be applied a grid wire 2*a* of the scorotron charger 2 in such a way as to keep the surface potential of the photosensitive drum 1 at a desired potential. This technical art is based on the fact that the surface potential of the photosensitive drum 1 depends on the potential of the grid wire 2*a*.

However, the scorotron charger 2 has to be made detachably mountable with respect to a power-feeding contact portion of the main body of the image forming apparatus, in consideration of service maintenance or the like of the main body of the image forming apparatus. Accordingly, if the scorotron charger 2 fails to be securely set to the power-feeding contact portion of the main body of the image forming apparatus, there may occur such a state that only a contact of the current receiving portion for the charging wire of the scorotron charger 2 is connected to the power-feeding contact portion of the main body of the image forming apparatus, while a contact for the potential of the grid wire 2*a* does not come into contact with the power-feeding contact portion of the main body of the image forming apparatus.

In the above state, the current in the charging wire would flow directly to the photosensitive drum 1, thereby causing leakage on the surface of the photosensitive drum 1, so that it may be expected that the photosensitive layer of the photosensitive drum 2 is damaged.

BRIEF SUMMARY OF THE INVENTION

It is an object of the present invention to provide an image forming apparatus capable of preventing a photosensitive member from being damaged, even if a charger is improperly mounted in the image forming apparatus.

To attain the above object, in accordance with one aspect of the invention, there is provided an image forming apparatus, which comprises an image bearing member, a charger detachably mountable with respect to a main body of the image forming apparatus for charging the image bearing member, the charger comprising a charging wire, a first electric terminal for receiving electric power to be supplied to the charging wire, a grid for keeping a charging potential of the image bearing member at a predetermined potential, and a second electric terminal for receiving electric power to be supplied to the grid, a first electric contact member for feeding electric power to the first electric terminal, and a second electric contact member for feeding electric power to the second electric terminal, wherein, in mounting the charger in the image forming apparatus, the first electric terminal comes into contact with the first electric contact member after the second electric terminal comes into contact with the second electric contact member.

The above and further objects and features of the invention will become apparent from the following detailed description of a preferred embodiment thereof taken in conjunction with the accompanying drawings.

DETAILED DESCRIPTION OF THE INVENTION

Hereinafter, a preferred embodiment of the invention will be described in detail with reference to the drawings.

Figure 1:
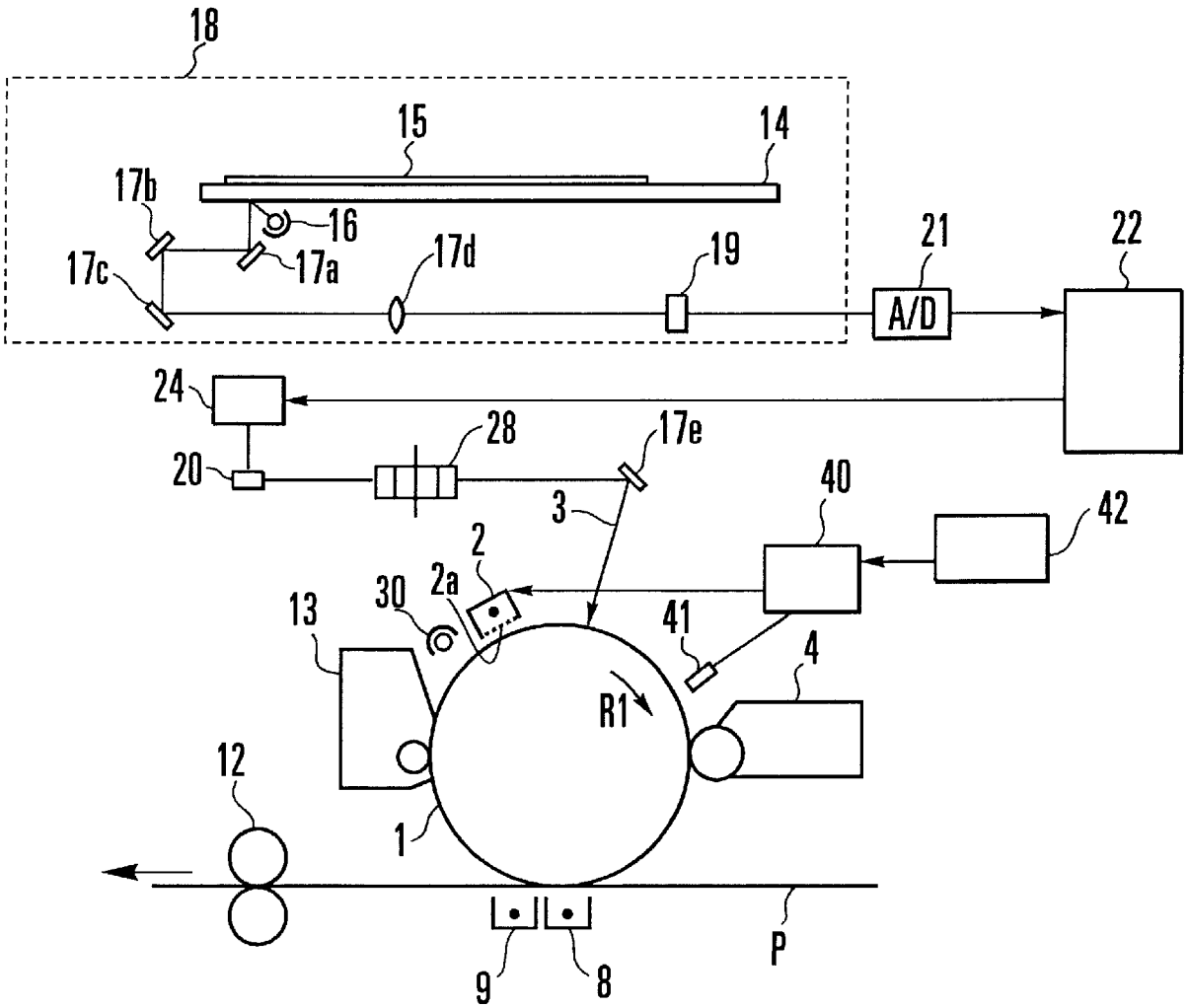
FIG. 1 is a schematic diagram showing the construction of an image forming apparatus according to an embodiment of the invention.

The construction of an image forming apparatus according to the embodiment of the invention is the same as that shown in FIG. 1, except for a power-feeding contact portion of the scorotron charger 2. Accordingly, further description of the same components as those shown in FIG. 1 will be omitted.

In the embodiment, as the photosensitive drum 1, there is used, by way of example, an amorphous silicon drum having features of high durability, long life and high image quality.

The details of the scorotron charger 2 will be described below. Corona discharging has local unevenness of discharging, and, also, the photosensitive drum 1 has local unevenness of charging capability, thereby causing unevenness of charging of the photosensitive drum 1.

If the scorotron charger 2 is adopted, however, since the charging potential of the photosensitive drum 1 is restricted by the voltage applied to the grid wire so that the surface potential of the photosensitive drum 1 is saturated, the unevenness of charging of the photosensitive drum 1 caused by the unevenness of discharging of corona discharging, the unevenness of charging capability of the photosensitive drum 1, or the like is absorbed.

By controlling the voltage of the grid wire, as mentioned above, the surface of the photosensitive drum 1 is made to be uniformly charged. In the case of the embodiment, the value of a primary current is 1,000 $\mu$A, and the potential of the grid wire is controlled by using that primary current value.

The construction of the scorotron charger 2 will be next described with reference to FIGS. 2A and 2B.

Figure 2A:
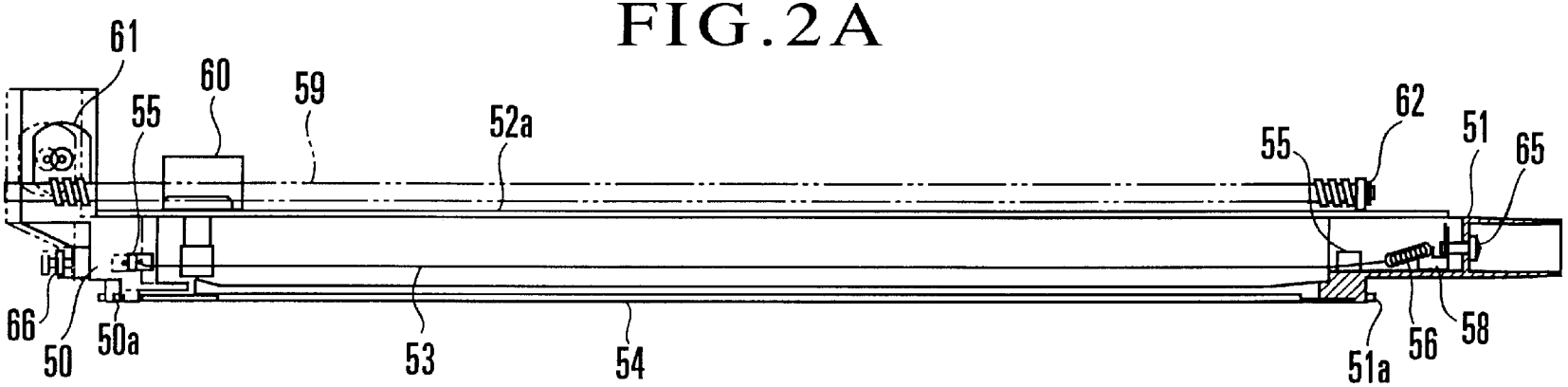
FIGS. 2A and 2B are diagrams showing the construction of a scorotron charger according to the embodiment of the invention.
Figure 2B:
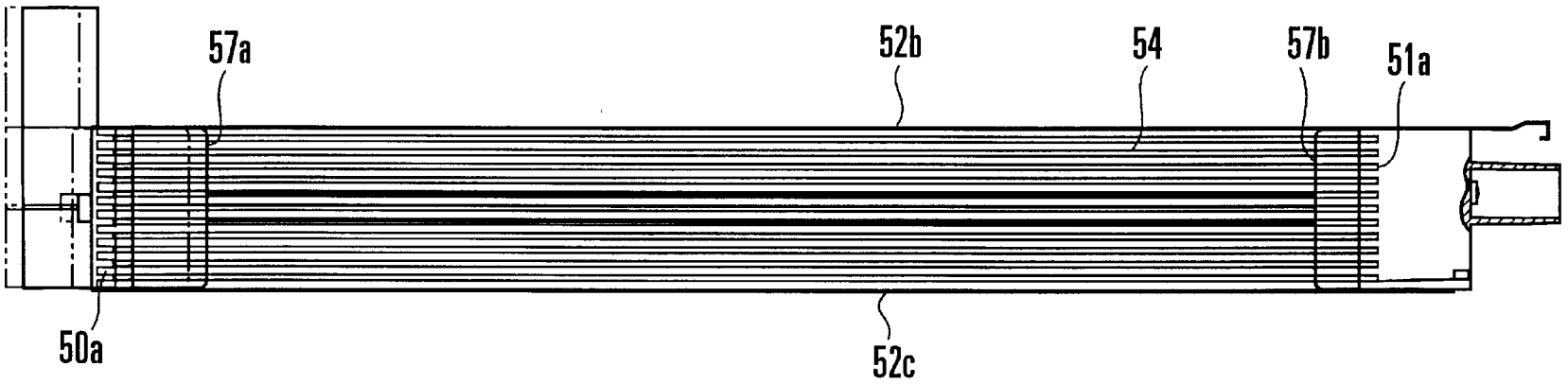

Referring to FIGS. 2A and 2B, the scorotron charger 2 is composed of a front block 50, a rear block 51, shield plates 52*a*, 52*b* and 52*c*, a charging wire 53, a grid wire 54, charging-wire-height adjusting bridges 55, a charging-wire spring 56, end-portion shield plates 57*a* and 57*b*, a spring supporting plate 58, a screw shaft 59, a charging-wire cleaning block 60, a driving motor 61, a take-up ring 62, a front-position adjusting part, a rear-position adjusting part, and so on.

The front block 50 and the rear block 51 are fixed to the shield plates 52*a*, 52*b* and 52*c*. The charging-wire-height adjusting bridges 55 are respectively mounted on the front block 50 and the rear block 51 with molded screws (not shown). The charging wire 53 is stretched between the front and rear charging-wire-height adjusting bridges 55. One end of the charging wire 53 is mounted on the spring supporting plate 58 via the charging-wire spring 56. The spring supporting plate 58 is fixed to the rear block 51 with a contact screw 65.

The grid wire 54 is alternately stretched between dowels 50*a* of the front block 50 and dowels 51*a* of the rear block 51, so that a grid surface is formed by the grid wire 54 stretched at a fixed interval as shown in FIG. 2B.

The grid surface may be a flat surface, or may be a curved surface matched with the curved surface of the photosensitive drum 1. In forming the grid surface, it is necessary to pull the grid wire 54 at a constant tension so as to prevent the grid wire 54 from loosening. For that purpose, the front block 50 is arranged to be movable up to a position indicated by two-dot chain lines by loosening the front block 50 from the shield plates 52*a*, 52*b* and 52*c* and pushing the shield plate 52*a* with a screw 66. Accordingly, the tension of the grid wire 54 can be adjusted within the range of the movement of the front block 50.

After completion of the adjustment of the tension of the grid wire 54, the front block 50 is made to be fixed to the shield plates 52*a*, 52*b* and 52*c*.

Further, end portions of the grid wire 54 are fixed to the shield plate 52*a* with screws, and the shield plates 52*a*, 52*b* and 52*c* are electrically connected to each other by means of a conductive plate (not shown). Therefore, when a bias voltage is applied to the grid wire 54, the shield plate 52*a* is arranged to also receive the same bias voltage.

Next, a description will be made about contact portions for applying a voltage to the grid wire and for supplying a current to the charging wire from the power-feeding side of the main body of the image forming apparatus for the purpose of feeding electric power to the scorotron charger 2, with reference to FIGS. 3A and 3B.

Figure 3A:
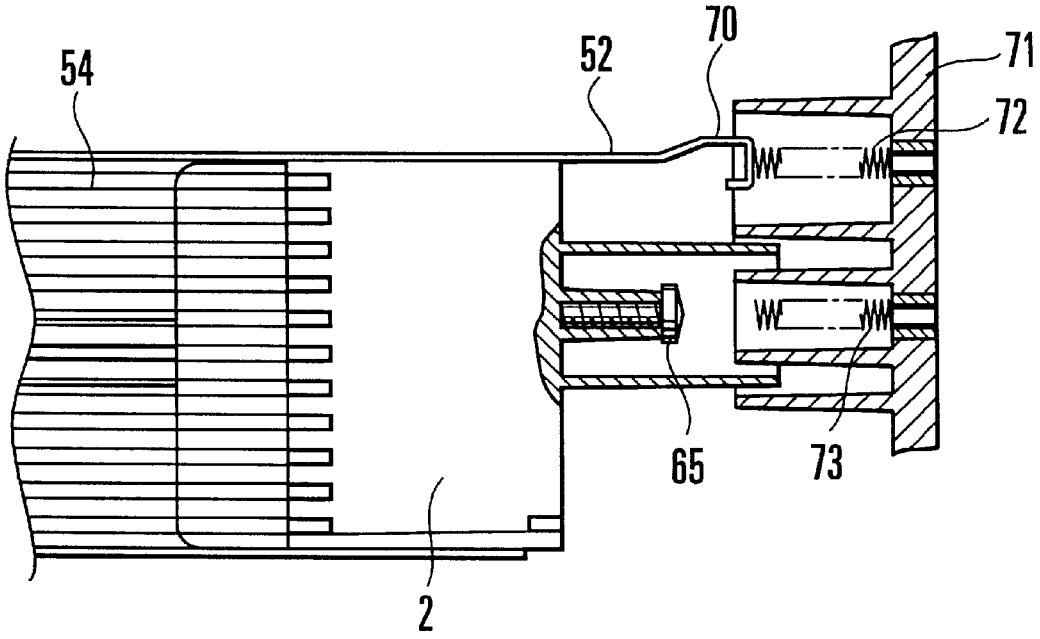
FIGS. 3A and 3B are diagrams showing the states of contacts of the scorotron charger with respect to a contact portion of the main body of the image forming apparatus according to the embodiment of the invention, FIG. 3A being a cross-sectional view showing a state in which the scorotron charger is in process of being inserted into the image forming apparatus, and FIG. 3B being a cross-sectional view showing a state in which the scorotron charger has been inserted in the normal position of the image forming apparatus.
Figure 3B:
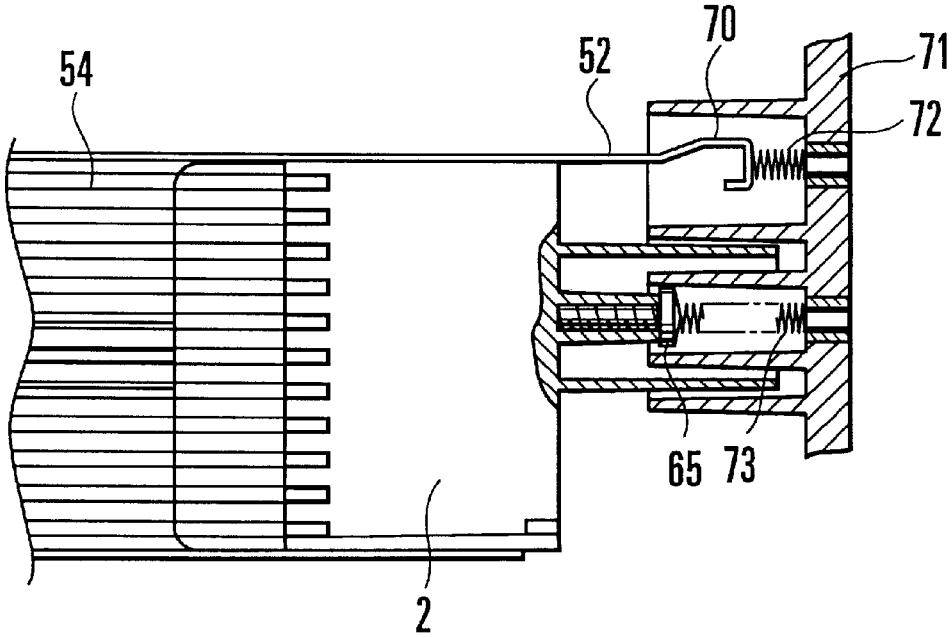

FIG. 3A is a diagram showing the state of the contact portions where the scorotron charger 2 is in process of being inserted into the main body of the image forming apparatus, and FIG. 3B is a diagram showing the state of the contact portions where the scorotron charger 2 has been inserted in the normal position of the main body of the image forming apparatus.

Referring first to FIG. 3A, in the scorotron charger 2, the shield plate 52*b* is electrically connected to the grid wire 54 and is provided with, at one end portion thereof, a grid contact portion 70 used for feeding electric power to the grid wire 54. Further, the contact screw 65 serves as a contact portion used for feeding electric power to the charging wire 53.

Further, the main body of the image forming apparatus is provided with a power-feeding block 71, which has a grid-bias spring 72 and a charging-wire spring 73. To the grid-bias spring 72, a controllable potential is applied, and, to the charging-wire spring 73, a current of 1,000 $\mu$A is supplied.

Now, as the scorotron charger 2 is being inserted into the power-feeding block 71 of the main body of the image forming apparatus, the grid contact portion 70 first comes into contact with the grid-bias spring 72. In this instance, the contact screw 65 and the charging-wire spring 73 are in such a positional relationship that the contact screw 65 has not yet come into contact with the charging-wire spring 73.

Next, FIG. 3B shows a state where the scorotron charger 2 has been pushed and inserted up to the normal position thereof. This is the first time that the contact screw 65 comes into contact with the charging-wire spring 73, so that the normal feeding of electric power can be performed.

Thus, the contact portions between the scorotron charger 2 and the power-feeding block 71 are arranged such that the length of protrusion of the shield plate 52*b* from the scorotron charger 2 is greater than the length of protrusion of the contact screw 65 from the scorotron charger 2, i.e., the shield plate 52*b* protrudes from the scorotron charger 2 to an extent greater than the contact screw 65. Accordingly, the shield plate 52*b* used for receiving the potential for the grid wire 54 becomes conductive with the grid-bias spring 72 always earlier than the time when the contact screw 65 used for receiving the current for the charging wire 53 becomes conductive with the charging-wire spring 73.

Incidentally, while, in the case of the embodiment, the above structural arrangement is attained by varying the lengths of protrusion of the shield plate 52*b* and the contact screw 65 of the scorotron charger 2, the same advantageous effect may be obtained by varying the spring lengths of the grid-bias spring 72 and the charging-wire spring 73, which are contact springs provided on the side of the power-feeding block 71.

As has been described above, the power-feeding terminal of the charging wire does not come into contact with an associated power-feeding contact portion of the image forming apparatus as long as the power-feeding terminal of the grid wire does not come into contact with an associated power-feeding contact portion of the image forming apparatus. Therefore, at power-feeding contacts for a bias voltage for the grid wire and a current for the charging wire in the scorotron charger, the contact for a bias voltage for the grid wire comes into contact with the associated power-feeding contact portion of the image forming apparatus always earlier than the contact for a current for the charging wire. As a result, in the event of, for example, service maintenance for the image forming apparatus, even if the power supply of the main body of the image forming apparatus is accidentally turned on in such a state where the scorotron charger has been inserted to the middle position other than the normal position in the main body of the image forming apparatus, it is possible to prevent the generation of current leakage to the photosensitive drum.

The individual components shown in schematic or block form in the drawings are all well-known in the arts of the image forming apparatus and their specific construction and operation are not critical to the operation or best mode for carrying out the invention.

While the present invention has been described with respect to what is presently considered to be the preferred embodiment, it is to be understood that the invention is not limited to the disclosed embodiment. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus, comprising:

an image bearing member;

a charger detachably mountable with respect to a main body of said image forming apparatus for charging said image bearing member, said charger comprising a charging wire, a first electric terminal for receiving electric power to be supplied to said charging wire, a grid for keeping a charging potential of said image bearing member at a predetermined potential, and a second electric terminal for receiving electric power to be supplied to said grid;

a first electric contact member for feeding electric power to said first electric terminal; and a second electric contact member for feeding electric power to said second electric terminal, wherein, in mounting said charger in said image forming apparatus, said first electric terminal comes into contact with said first electric contact member after said second electric terminal comes into contact with said second electric contact member.

2. An image forming apparatus according to claim 1, wherein said second electric terminal protrudes in a direction of insertion of said charger to an extent greater than said first electric terminal.

3. An image forming apparatus according to claim 1, wherein said second electric contact member protrudes toward said charger to an extent greater than said first electric contact member.

* * * * *

UNITED STATES PATENT AND TRADEMARK OFFICE

CERTIFICATE OF CORRECTION

PATENT NO. : 6,091,917

DATED : July 18, 2000

INVENTOR : KUZUAKI AOKI

It is certified that error appears in the above-identified patent and that said Letters Patent is hereby corrected as shown below:

COVER PAGE

After [22] Filed, please insert
--[30] Foreign Application Priority Data
February 10, 1998 [JP] Japan .....10-280962--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*